US006430854B1

(12) United States Patent
Szentgyorgyi et al.

(10) Patent No.: US 6,430,854 B1
(45) Date of Patent: Aug. 13, 2002

(54) INSPECTION AND REGISTRATION HOLDER

(76) Inventors: Erno Szentgyorgyi; Eunika Szentgyorgyi, both of 146 N. Hwy., Hampton-Bays, NY (US) 11946

( * ) Notice: Subject to any disclaimer, the term of this patent is extended or adjusted under 35 U.S.C. 154(b) by 36 days.

(21) Appl. No.: 09/661,225

(22) Filed: Sep. 13, 2000

(51) Int. Cl.[7] ..... G09F 21/04

(52) U.S. Cl. ..... 40/593; 40/643; 40/644; 40/661.06; 40/654.01

(58) Field of Search ..... 40/643, 644, 593, 40/651, 661, 661.06, 661.07, 654.01, 747, 492

(56) References Cited

U.S. PATENT DOCUMENTS

| | | | | | |
|---|---|---|---|---|---|
| 1,436,544 | A | * | 11/1922 | Starr | 40/747 |
| 2,223,308 | A | * | 11/1940 | Rovell | 40/747 |
| 2,303,926 | A | * | 12/1942 | Fluger | 40/593 |
| 2,535,576 | A | * | 12/1950 | Hodges, Sr. | 40/643 |
| 2,833,072 | A | * | 5/1958 | Gregory | 40/591 |
| 2,887,804 | A | | 5/1959 | Wise | 40/152.1 |
| 3,168,070 | A | * | 2/1965 | Verney, III | 40/593 |
| 3,237,327 | A | | 3/1966 | Griggs | 40/10 |
| 3,237,330 | A | * | 3/1966 | Dinstbir | 40/593 |
| 3,293,779 | A | * | 12/1966 | Vogeli, Sr. | 40/643 |
| 3,313,053 | A | | 4/1967 | Vogeli, Sr. | 40/10 |
| 3,531,880 | A | * | 10/1970 | Ramee | 40/643 |
| 3,533,178 | A | * | 10/1970 | Strohmaier | 40/643 |
| 4,132,022 | A | * | 1/1979 | Wood, Jr. | 40/530 |
| 4,184,276 | A | | 1/1980 | Hernandez | 40/10 |
| D266,338 | S | | 9/1982 | Mandel | D20/43 |
| 4,470,214 | A | * | 9/1984 | Kinloch | 40/593 |
| 4,736,539 | A | * | 4/1988 | Dickinson | 40/591 |
| 5,408,774 | A | * | 4/1995 | Grewe et al. | 40/606 |
| 5,502,912 | A | * | 4/1996 | LeBoff et al. | 40/593 |
| 6,070,349 | A | * | 6/2000 | Fantone et al. | 40/661.06 |
| 6,163,997 | A | * | 12/2000 | Deralas | 40/651 |
| 6,343,006 | B1 | * | 1/2002 | Moscovitch et al. | 361/681 |

* cited by examiner

*Primary Examiner*—Lynne H. Browne
*Assistant Examiner*—James M. Hewitt

(57) ABSTRACT

An inspection and registration holder having a transparent envelope with a cylindrical bottom, a base having a cavity for receiving the cylindrical bottom and an adjustment screw for fixing the envelope in one of a plurality of predetermined positions when the envelope is rotated about the cylindrical bottom.

7 Claims, 3 Drawing Sheets

INSPECTION AND REGISTRATION HOLDER

BACKGROUND OF THE INVENTION

1. Field of the Invention

The present invention relates to an apparatus for securing automobile documents to the dashboard of an automotive vehicle so that the documents are visible through the windshield of the vehicle.

2. Description of the Prior Aat

Inspection and Registration documents for automotive vehicles are required by all states. Holders for inspection and registration cards allow the documents to be seen through the windshield of the vehicle. U.S. Pat. No. 2,887,804 discloses a dashboard mounted picture frame having two panels for holding a picture between the plates. U.S. Pat. No .3,237,327 discloses an automobile certificate holder having an envelope structure affixed to the vehicle by a plurality of magnets stapled to the envelope. U.S. Pat. No .3,313,053 discloses a rectangular flat plate with a card receiving pocket secured to the vehicle by magnets or to the mirror support. U.S. Pat. No. 4,184,276 discloses a holder having slot to receive the automobile registration document and a flexible material coated with pressure sensitive adhesive for affixing the holder to the windshield of the automobile.

What is needed beyond the prior art is a holder that is adaptable to mounting on the dashboard of a vehicle, that can hold both the registration and inspection cards and that can be adjusted to the align with the angle of the windshield of the vehicle.

SUMMARY OF THE INVENTION

The present invention meets the needs identified above by providing an apparatus having a transparent envelope with a cylindrical bottom, a base having a cavity for receiving the cylindrical bottom and an adjustment screw for fixing the envelope in one of a plurality of predetermined positions when the envelope is rotated about the cylindrical bottom.

The foregoing and other objects, features and advantages of the invention will be apparent from the following more particular description of a preferred embodiment of the invention, as illustrated in the accompanying drawings wherein like reference numbers represent like parts of the invention.

DESCRIPTION OF PREFERRED EMBODIMENTS

Figure 1:
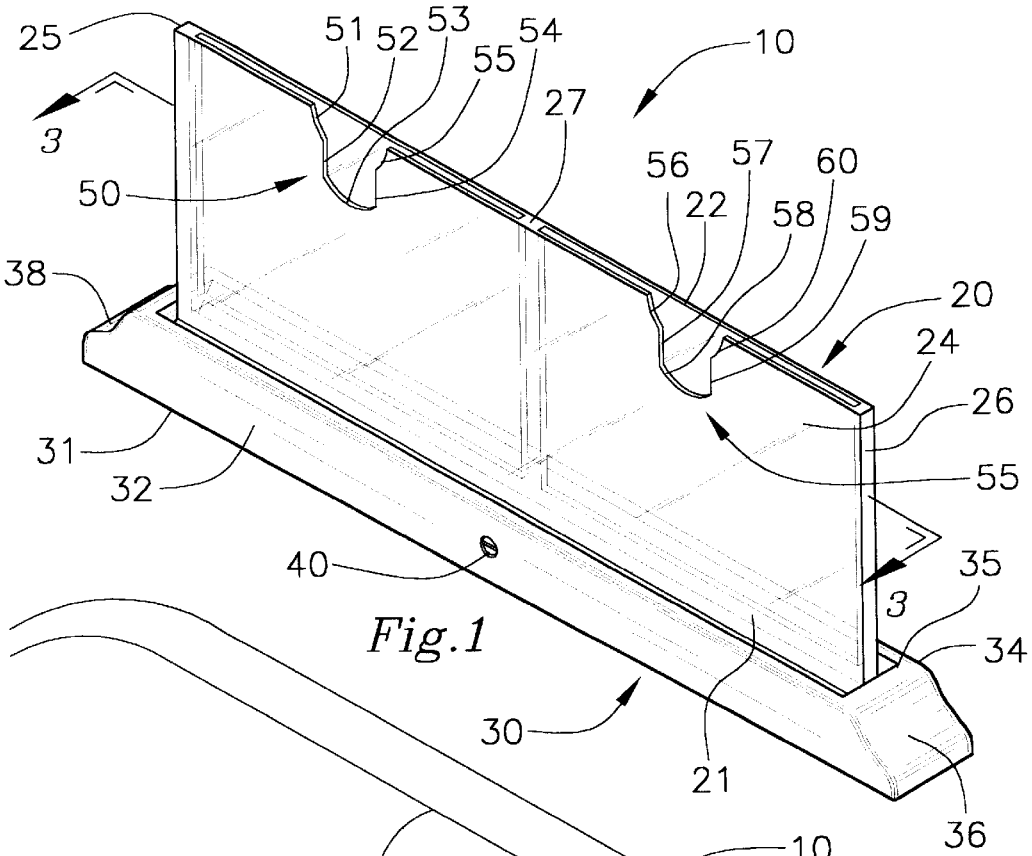
FIG. 1 is a left rear perspective view of the holder.

In FIG. 1, depicts holder 10 having envelope 20 rotatably affixed to base 30. Envelope 20 has envelope front side 22, envelope rear side 24, envelope first end 26, envelope second end 25 and envelope center post 27. Envelope center post 27 divides envelope 20 into a first compartment between center post 27 and envelope first end 26 and a second compartment between envelope second end 25 and envelope center post 27. In the preferred embodiment, the first compartment is 4 inches long, the second compartment is approximately 4 and ¾ inches long and the overall length of envelope 20 is approximately 9 inches. The height of envelope 20 above base 30 at envelope second end 25 is approximately 3 inches. Envelope rear side 24 has first aperture 55 having first aperture first curve section 56, first aperture first vertical section 57, first aperture bottom curve section 58, first aperture second vertical section 59 and first aperture second curve section 60. Envelope rear side 24 has second aperture 50 having second aperture first curve section 51, second aperture first vertical section 52, second aperture bottom curve section 53, second aperture second vertical section 54 and second aperture second curve section 55. First aperture 55 and second aperture 50 allow a user to grasp a card inserted into the first compartment or the second compartment of envelope 20. Base 30 has base first end 36, base second end 38, base front 34 and base rear 32. Base 30 has adjustment screw 40. Base 30 has base top surface 35 and base bottom 31. Base second end 38 is higher than base first end 36 so that base top surface 35 is at a greater distance from base bottom 31 where base top surface meets base second end 38 than where base top surface meets base first end 36. The difference in height between base first end 36 and base second end 38 allows base top surface 35 to be level when base 30 is mounted onto the dashboard of a motor vehicle. In the preferred embodiment base first end 36 is approximately ½ inch in height and base second end 38 is approximately ⅞ inch in height. Also in the preferred embodiment, the distance from the outermost edge of base first end 36 to the outermost edge of base second end 38 is approximately 10 and ¼ inches. Envelope 20 is rotatably and fixedly engaged in base 30. In the preferred embodiment, envelope 20 is made from clear and transparent plastic.

Figure 2:
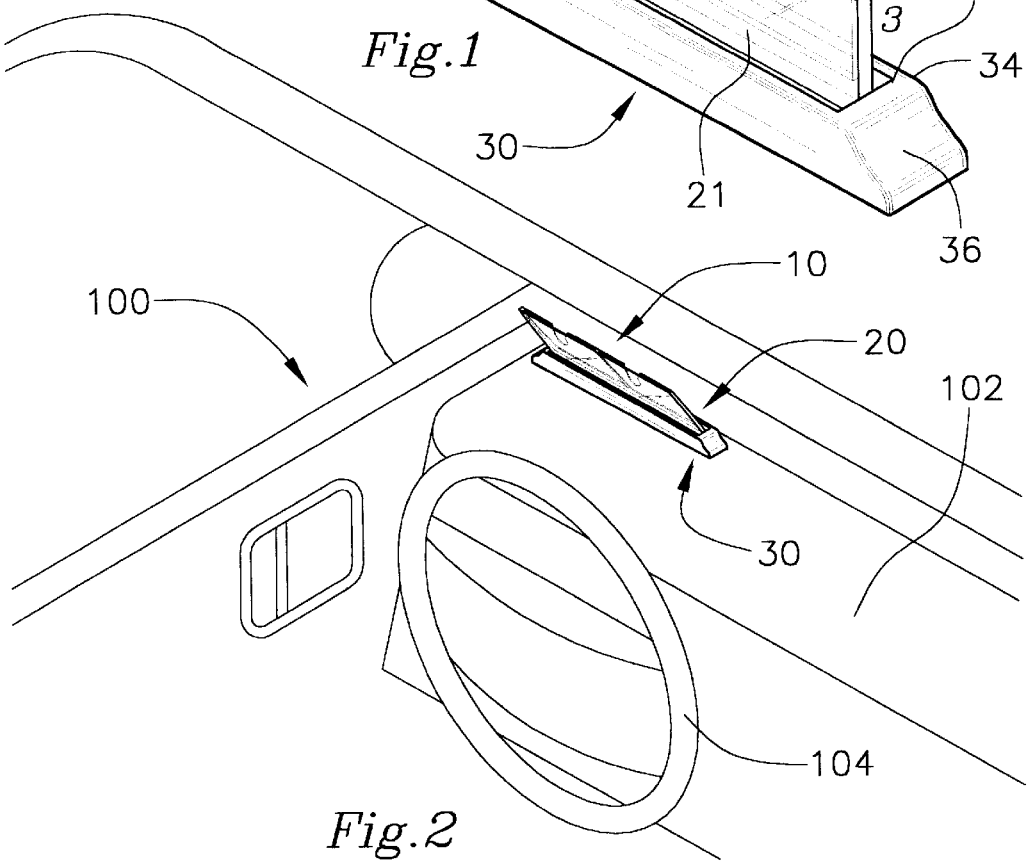
FIG. 2 depicts the holder affixed to the dashboard of a vehicle.

FIG. 2 depicts motor vehicle 100 having dashboard 102 and steering wheel 104. Base 30 is mounted on dashboard 102. Envelope 20 is angled to parallel the windshield of automotive vehicle 100. Base 30 is positioned so that documents in the first compartment and second compartment of envelope 20 will be visible through the left bottom comer of the windshield. Documents in the first compartment and second compartment of envelope 20 can be easily removed by reaching over steering wheel 104 and grasping the documents through first aperture 55 and second aperture 50 (see FIG. 1).

Figure 3:
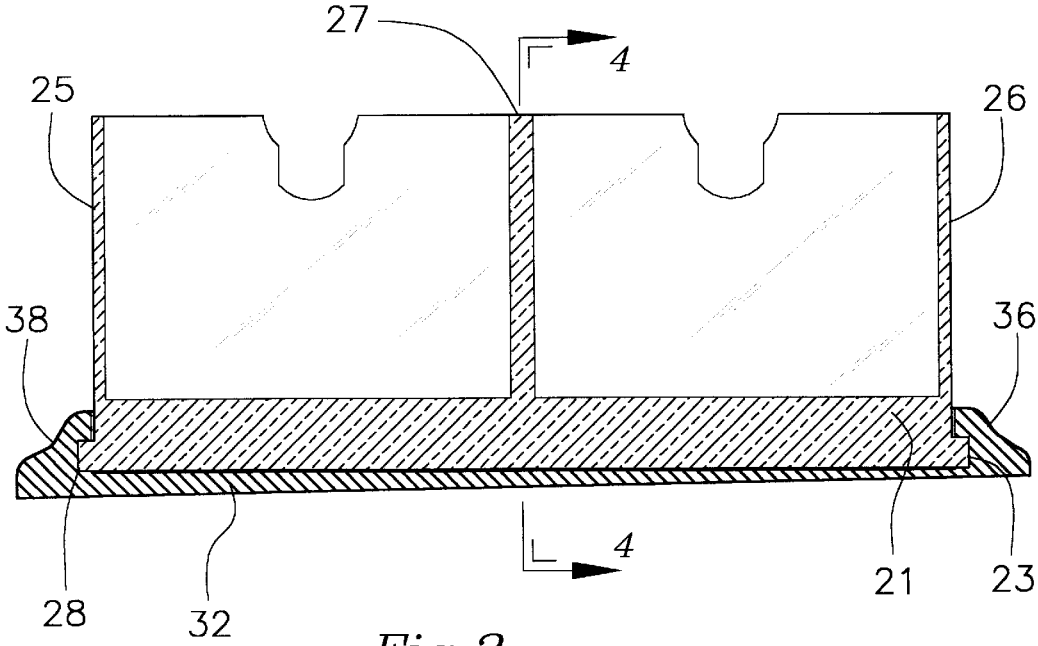
FIG. 3 is a view along cut line 3—3 of FIG. 1.

FIG. 3 shows a cross sectional view of holder 10 along cut line 3—3 of FIG. 1. Envelope first end 26 has first cylindrical projection 23 fixedly engaged to envelope first end 26. Envelope second end 25 has second cylindrical projection fixedly engaged to envelope second end 25. Base first end 36 has a cylindrical aperture for receiving first cylindrical projection 23. Base second end 38 has an aperture for receiving second cylindrical projection 23.

Figure 4:
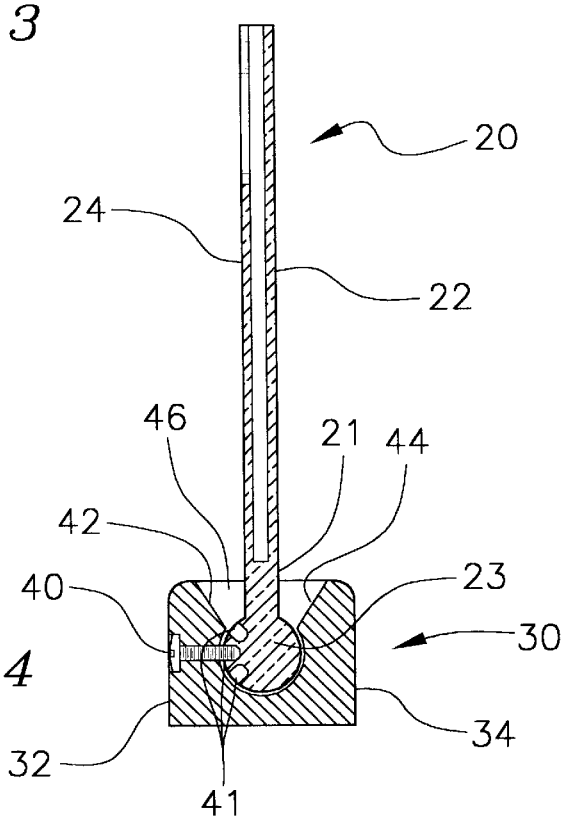
FIG. 4 is a view along cut line 4—4 of FIG. 3.

FIG. 4 shows a view along cut line 4—4 of FIG. 3. Base 30 has cavity 46 for receiving envelope 20. Cavity 46 has front slope 44, rear slope 42 and cylindrical aperture 35. Envelope 20 has cylindrical bottom 23. Envelope 20 is capable of rotating about cylindrical bottom 23 in cylindrical aperture 35 until envelope front side 22 contacts front slope 44 or envelope rear side 24 contacts rear slope 42. Cylindrical bottom 23 has a plurality of screw apertures 41 for receiving adjustment screw 40. In the preferred embodiment there are three screw apertures to provide three different angles for envelope 20 in relationship to base 30 and dashboard 102 of vehicle 100 (see FIG. 2).

Figure 5:
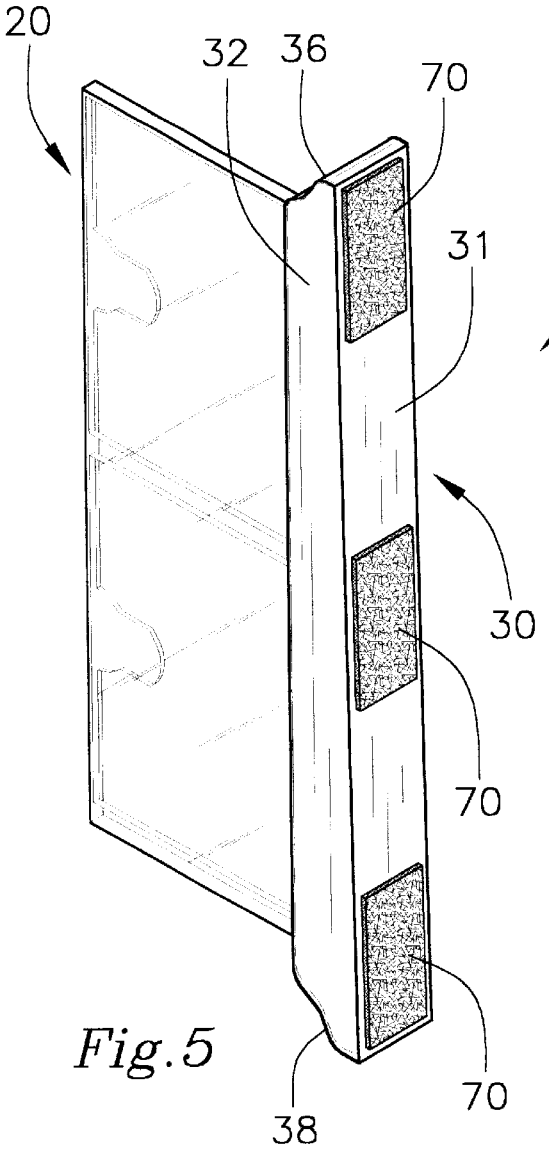
FIG. 5 is a left bottom perspective view of the holder with velcro fasteners.
Figure 6:
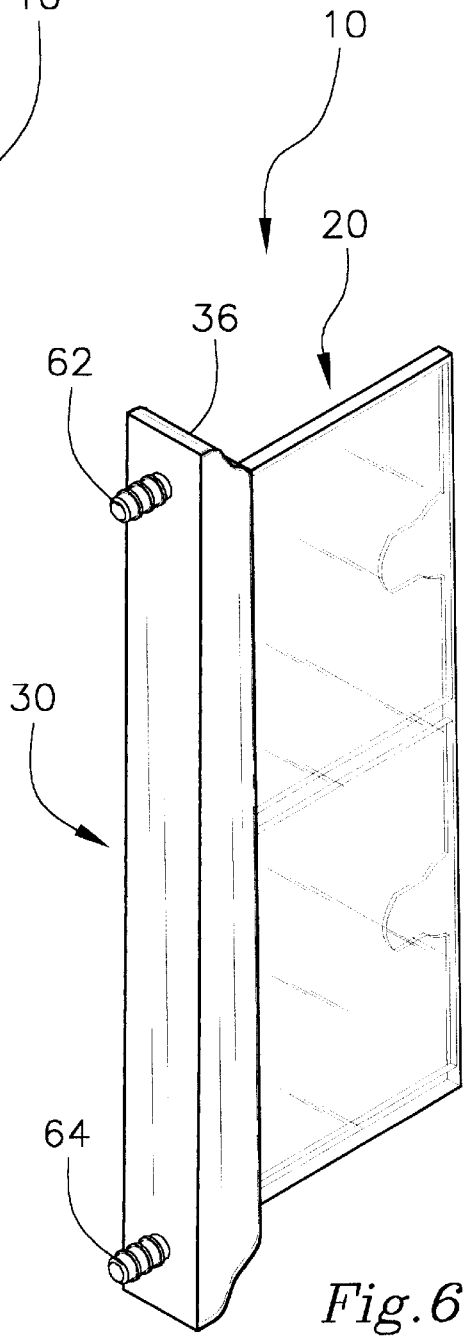
FIG. 6 is a right bottom perspective view of the holder with screw fasteners.

FIG. 5 shows a bottom view of base 30. In the preferred embodiment, base 30 is affixed to dashboard 102 by velcro fasteners 70. FIG. 6 shows an alternative embodiment in which base 30 is affixed to dashboard 102 by stud attachments 64. In order to adapt dashboard 102 for receiving stud attachments 64 holes must be drilled in dashboard 102 and an optional template (not shown) may be provided with holder 10 for properly positioning holes for receiving stud attachments 64.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

We claim:

1. An apparatus which displays documents on the dashboard of a motor vehicle having a windshield comprising:

an envelope with a cylindrical bottom;

a base having a cavity for receiving the cylindrical bottom;

an adjustment screw;

a first aperture in the base for receiving the adjustment screw;

at least one second aperture in the cylindrical bottom capable of receiving the adjustment screw;

wherein the cylindrical bottom can rotate within the cavity; and wherein the adjustment screw passes through the first aperture and into one of the second apertures and rigidly affixes the cylindrical bottom to the base so that the cylindrical bottom cannot rotate within the base;

wherein the cavity further comprises a cylindrical aperture, a front slope and a rear slope.

2. The apparatus of claim 1 wherein the envelope further comprises a first compartment and a second compartment.

3. The apparatus of claim 1 wherein the base further comprises a first end and a second end; and wherein the height of said second end is greater than that height of said first end.

4. The apparatus of claim 1 wherein the base further comprises a plurality of hook and loop fasteners.

5. The apparatus of claim 1 wherein the base further comprises a plurality of stud fasteners.

6. The apparatus of claim 1 wherein the envelope further comprises a first aperture and a second aperture; and wherein said first aperture and said second aperture have a first curve section, a first vertical section, a bottom curved section, a second vertical section and a second curved section.

7. The apparatus of claim 1 wherein said envelope is made from a clear and transparent plastic.

* * * * *